US006210505B1

(12) United States Patent
Khandhadia et al.

(10) Patent No.: US 6,210,505 B1
(45) **Date of Patent: *Apr. 3, 2001**

(54) HIGH GAS YIELD NON-AZIDE GAS GENERANTS

(76) Inventors: Paresh S. Khandhadia, 6697 Redford Cir., Troy, MI (US) 48098; Sean P. Burns, 2779 Davison Ave., Auburn Hills, MI (US) 48326; Graylon K. Williams, 160½ West St., Romeo, MI (US) 48065

( * ) Notice: Subject to any disclaimer, the term of this patent is extended or adjusted under 35 U.S.C. 154(b) by 0 days.

This patent is subject to a terminal disclaimer.

(21) Appl. No.: 09/159,166

(22) Filed: Sep. 23, 1998

Related U.S. Application Data

(63) Continuation-in-part of application No. 08/745,949, filed on Nov. 8, 1996, now Pat. No. 5,872,329.

(51) Int. Cl.[7] ..... C06B 31/32; C06B 47/08

(52) U.S. Cl. ..... 149/36; 149/46; 149/47; 149/109.2

(58) Field of Search ..... 149/36, 46, 47, 149/109.2

(56) References Cited

U.S. PATENT DOCUMENTS 3,719,604 * 3/1973 Prior et al. ..... 252/186
4,909,549 * 3/1990 Poole et al. ..... 280/738
4,925,503 * 5/1990 Canterberry et al. ..... 149/19.4
5,074,938 * 12/1991 Chi ..... 149/21
5,256,792 10/1993 Lee et al. ..... 548/263.8
5,501,823 * 3/1996 Lund et al. ..... 264/3.1
5,516,377 * 5/1996 Highsmith et al. ..... 149/18
5,531,941 * 7/1996 Poole ..... 264/3.4
5,723,812 * 3/1998 Berteleau et al. ..... 149/46
5,783,773 * 7/1998 Poole ..... 149/109.2
5,872,329 * 2/1999 Burns et al. ..... 149/36
5,962,808 * 10/1999 Lundstrom ..... 149/19.1
6,017,404 * 1/2000 Lundstrom et al. ..... 149/36
6,019,861 * 2/2000 Canterberry et al. ..... 149/19.1
6,045,638 * 4/2000 Lundstrom ..... 149/36
6,123,790 * 9/2000 Lundstrom et al. ..... 149/47
6,149,746 * 11/2000 Blomquist ..... 149/46

* cited by examiner

*Primary Examiner*—Peter A. Nelson
(74) *Attorney, Agent, or Firm*—Lyon P.C.

(57) ABSTRACT

High nitrogen nonazide gas compositions, useful in inflating passenger restraint gas inflator bags, comprise a nonmetal salt of triazole or tetrazole fuel, phase stabilized ammonium nitrate (PSAN) as a primary oxidizer, a metallic second oxidizer, and an inert component such as clay or mica. The combination of these constituents results in gas generants that are relatively more stable and less explosive, have improved ignitability and satisfactory burn rates, have sustained combustion throughout the various combustion pressures at the inflator level, and generate more gas and less solids than known gas generant compositions.

16 Claims, 1 Drawing Sheet

HIGH GAS YIELD NON-AZIDE GAS GENERANTS

CROSS-REFERENCE TO RELATED APPLICATIONS

Figure 1:
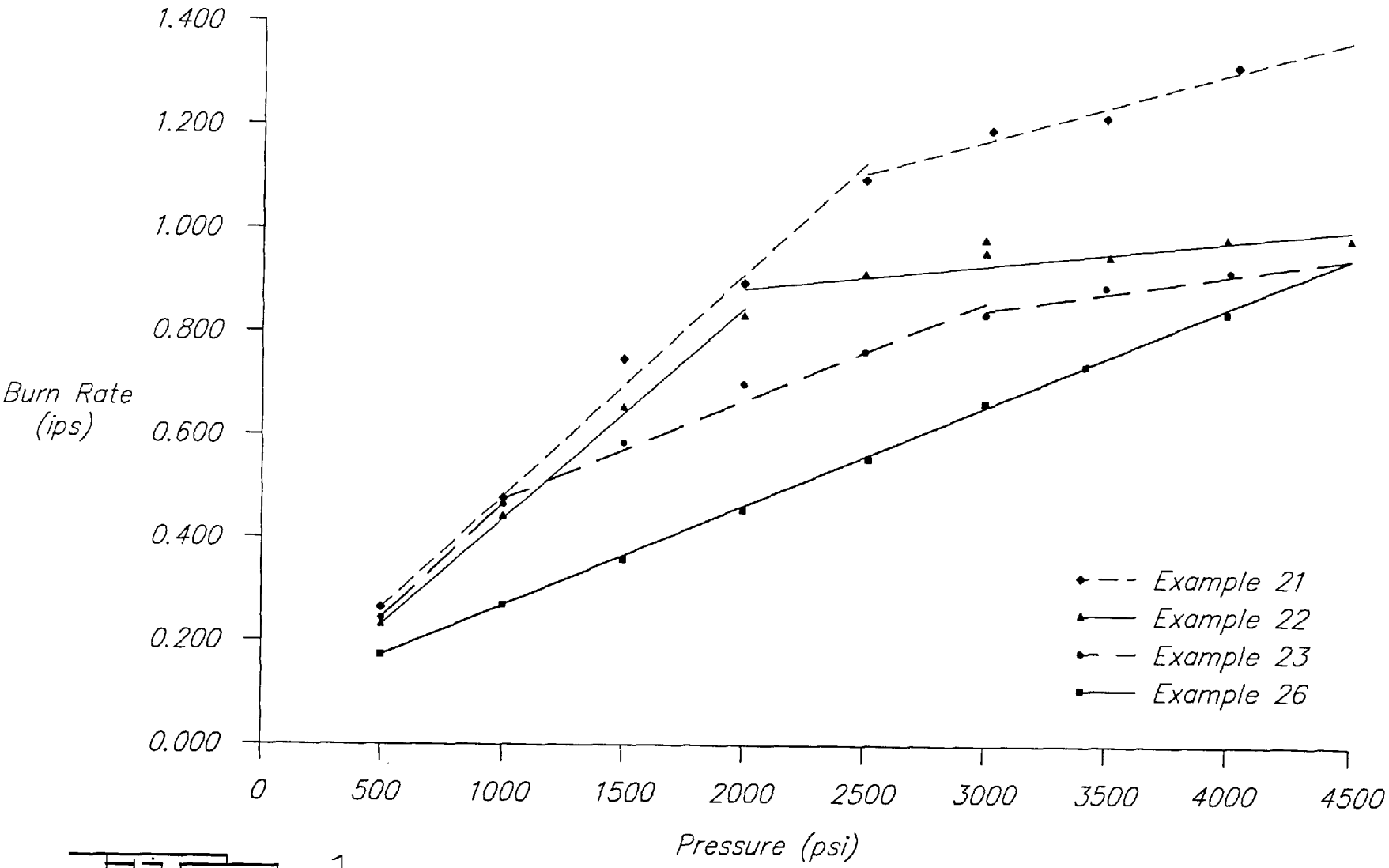

The present application is a continuation-in-part of U.S. patent application Ser. No. 08/745,949 filed on Nov. 8, 1996, and now U.S. Pat. No. 5,872,329.

BACKGROUND OF THE INVENTION

The present invention relates to nontoxic gas generating compositions which upon combustion, rapidly generate gases that are useful for inflating occupant safety restraints in motor vehicles and specifically, the invention relates to nonazide gas generants that produce combustion products having not only acceptable toxicity levels, but that also exhibit a relatively high gas volume to solid particulate ratio at acceptable flame temperatures. Additionally, the compositions of the present invention readily ignite and sustain combustion at burn rates heretofore thought to be too low for automotive airbag applications.

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are hereby incorporated by reference.

In addition to a fuel constituent, pyrotechnic nonazide gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. The solids produced as a result of combustion must be filtered and otherwise kept away from contact with the occupants of the vehicle. It is therefore highly desirable to develop compositions that produce a minimum of solid particulates while still providing adequate quantities of a nontoxic gas to inflate the safety device at a high rate.

It is known that the use of ammonium nitrate as an oxidizer contributes to the gas production with a minimum of solids. To be useful, however, gas generants for automotive applications must be thermally stable when aged for 400 hours or more at 107° C. The compositions must also retain structural integrity when cycled between −40° C. and 107° C.

Generally, gas generant compositions using ammonium nitrate are thermally unstable propellants that produce unacceptably high levels of toxic gases, CO and $NO_x$ for example, depending on the composition of the associated additives such as plasticizers and binders. Known ammonium nitrate compositions are also hampered by poor ignitability, delayed burn rates, and significant performance variability. Several prior art compositions incorporating ammonium nitrate utilize well known ignition aids such as $BKNO_3$ to solve this problem. However, the addition of an ignition aid such as $BKNO_3$ is undesirable because it is a highly sensitive and energetic compound.

Yet another problem that must be addressed is that the U.S. Department of Transportation (DOT) regulations require "cap testing" for gas generants. Because of the sensitivity to detonation of fuels often used in conjunction with ammonium nitrate, most propellants incorporating ammonium nitrate do not pass the cap test unless shaped into large disks, which in turn reduces design flexibility of the inflator.

Accordingly, many nonazide propellants based on ammonium nitrate cannot meet requirements for automotive applications. Two notable exceptions are disclosed in U.S. Pat. No. 5,531,941 in which the use of phase-stabilized ammonium nitrate, triaminoguanidine nitrate, and oxamide is taught, and, in U.S. Pat. No. 5,545,272 in which the use of phase-stabilized ammonium nitrate and nitroguanidine is taught. Despite their usefulness in automotive applications, these compositions are still problematic because triaminoguanidine nitrate and nitroguanidine are explosive fuels that complicate transportation requirements and passing the cap test. Furthermore, because of poor ignitability and a relatively low burn rate, the nitroguanidine composition requires a conventional ignition aid such as $BKNO_3$ which is both sensitive and very energetic.

Certain gas generant compositions comprised of ammonium nitrate are thermally stable, but have burn rates less than desirable for use in gas inflators. To be useful for passenger restraint inflator applications, gas generant compositions generally require a burn rate of at least 0.40 ips (inches/second) at 1000 psi. In general, gas generants with burn rates of less than 0.40 ips at 1000 psi do not ignite reliably and often result in "no-fires" in the inflator wherein only a portion of the gas generant is combusted. Poor ignitability, even with complete combustion, results in a gas production rate too slow for automotive airbag applications.

DESCRIPTION OF THE PRIOR ART

The gas generant compositions described in Poole et al, U.S. Pat. Nos. 4,909,549 and 4,948,439, use tetrazole or triazole compounds in combination with metal oxides and oxidizer compounds (alkali metal, alkaline earth metal, and pure ammonium nitrates or perchlorates) resulting in a relatively unstable generant that decomposes at low temperatures. Significant toxic emissions and particulate are formed upon combustion. Both patents teach the use of $BKNO_3$ as an ignition aid.

The gas generant compositions described in Poole, U.S. Pat. No. 5,035,757, result in more easily filterable solid products but the gas yield is unsatisfactory.

Chang et al, U.S. Pat. No. 3,954,528, describes the use of triaminoguanidine nitrate ("TAGN") and a synthetic polymeric binder in combination with an oxidizing material. The oxidizing materials include ammonium nitrate ("AN") although the use of phase stabilized ammonium nitrate ("PSAN") is not suggested. The patent teaches the preparation of propellants for use in guns or other devices where large amounts of carbon monoxide and hydrogen are acceptable and desirable.

Grubaugh, U.S. Pat. No. 3,044,123, describes a method of preparing solid propellant pellets containing AN as the major component. The method requires use of an oxidizable organic binder (such as cellulose acetate, PVC, PVA, acrylonitrile and styrene-acrylonitrile), followed by compression molding the mixture to produce pellets and by heat treating the pellets. These pellets would certainly be damaged by temperature cycling because commercial AN is used and the composition claimed would produce large amounts of carbon monoxide.

Becuwe, U.S. Pat. No. 5,034,072, is based on the use of 5-oxo-3-nitro-1,2,4-triazole as a replacement for other explosive materials (HMX, RDX, TATB, etc.) in propellants and gun powders. This compound is also called 3-nitro-1,2,4-triazole-5-one ("NTO"). The claims appear to cover a gun powder composition which includes NTO, AN and an inert binder, where the composition is less hygroscopic than a propellant containing ammonium nitrate. Although called inert, the binder would enter into the combustion reaction and produce carbon monoxide making it unsuitable for air bag inflation.

Lund et al, U.S. Pat. No. 5,197,758, describes gas generating compositions comprising a nonazide fuel which is a transition metal complex of an aminoarazole, and in particular are copper and zinc complexes of 5-aminotetrazole and 3-amino-1,2,4-triazole which are useful for inflating air bags in automotive restraint systems, but generate excess solids.

Wardle et al, U.S. Pat. No. 4,931,112, describes an automotive air bag gas generant formulation consisting essentially of NTO (5-nitro-1,2,4-triazole-3-one) and an oxidizer wherein said formulation is anhydrous.

Ramnarace, U.S. Pat. No. 4,111,728, describes gas generators for inflating life rafts and similar devices or that are useful as rocket propellants comprising ammonium nitrate, a polyester type binder and a fuel selected from oxamide and guanidine nitrate.

Boyars, U.S. Pat. No. 4,124,368, describes a method for preventing detonation of ammonium nitrate by using potassium nitrate.

Mishra, U.S. Pat. No. 4,552,736, and Mehrotra et al, U.S. Pat. No. 5,098,683, describe the use of potassium fluoride to eliminate expansion and contraction of ammonium nitrate in transition phase.

Chi, U.S. Pat. No. 5,074,938, describes the use of phase stabilized ammonium nitrate as an oxidizer in propellants containing boron and useful in rocket motors.

Canterberry et al, U.S. Pat. No. 4,925,503, describes an explosive composition comprising a high energy material, e.g., ammonium nitrate and a polyurethane polyacetal elastomer binder, the latter component being the focus of the invention.

Hass, U.S. Pat. No. 3,071,617, describes long known considerations as to oxygen balance and exhaust gases.

Stinecipher et al, U.S. Pat. No. 4,300,962, describes explosives comprising ammonium nitrate and an ammonium salt of a nitroazole.

Prior, U.S. Pat. No. 3,719,604, describes gas generating compositions comprising aminoguanidine salts of azotetrazole or of ditetrazole.

Poole, U.S. Pat. No. 5,139,588, describes nonazide gas generants useful in automotive restraint devices comprising a fuel, an oxidizer and additives.

Chang et al, U.S. Pat. No. 3,909,322, teaches the use of nitroaminotetrazole salts with pure ammonium nitrate as gun propellants and gas generants for use in gas pressure actuated mechanical devices such as engines, electric generators, motors, turbines, pneumatic tools, and rockets.

Bucerius et al, U.S. Pat. No. 5,198,046, teaches the use of diguanidinium-5,5'-azotetrazolate with $KNO_3$ as an oxidizer, for use in generating environmentally friendly, non-toxic gases, and providing excellent thermal stability.

Onishi et al, U.S. Pat. No. 5,439,251, teaches the use of a tetrazole amine salt as an air bag gas generating agent comprising a cationic amine and an anionic tetrazolyl group having either an alkyl with carbon number 1–3, chlorine, hydroxyl, carboxyl, methoxy, aceto, nitro, or another tetrazolyl group substituted via diazo or triazo groups at the 5-position of the tetrazole ring. The focus of the invention is on improving the physical properties of tetrazoles with regard to impact and friction sensitivity, and does not teach the combination of a tetrazole amine salt with any other chemical.

Lund et al, U.S. Pat. No. 5,501,823, teaches the use of nonazide anhydrous tetrazoles, derivatives, salts, complexes, and mixtures thereof, for use in air bag inflators.

Highsmith et al, U.S. Pat. No. 5,516,377, teaches the use of a salt of 5-nitraminotetrazole, a conventional ignition aid such as $BKNO_3$, and pure ammonium nitrate as an oxidizer, but does not teach the use of phase stabilized ammonium nitrate.

Therefore, the objects of the invention include providing high yield (gas/mass>90%) gas generating compositions that produce large volumes of non-toxic gases with minimal solid particulates, that are thermally and volumetrically stable from −40° C. through 110° C., that contain no explosive components, and that ignite without delay and sustain combustion in a repeatable manner.

SUMMARY OF THE INVENTION

The aforementioned problems are solved by providing a nonazide gas generant for a vehicle passenger restraint system employing ammonium nitrate as an oxidizer and potassium nitrate as an ammonium nitrate phase stabilizer. The fuel, in combination with phase stabilized ammonium nitrate, is selected from the group consisting of amine and other nonmetal salts of tetrazoles and triazoles having a nitrogen containing cationic component and an anionic component. The anionic component comprises a tetrazole or triazole ring, and an R group substituted on the 5-position of the tetrazole ring, or two R groups substituted on the 3- and 5-positions of the triazole ring. The R group(s) is selected from hydrogen and any nitrogen-containing functional groups such as amino, nitro, nitramino, tetrazolyl and triazolyl groups. The cationic component is formed from a member of the group including ammonia, hydrazine; guanidine compounds such as guanidine, aminoguanidine, diaminoguanidine, triaminoguanidine, and nitroguanidine; amides including dicyandiamide, urea, carbohydrazide, oxamide, oxamic hydrazide, Bi-(carbonamide) amine, azodicarbonamide, and hydrazodicarbonamide; and substituted azoles including 3-amino-1,2,4-triazole, 3-amino-5-nitro-1,2,4-triazole, 5-aminotetrazole, 3-nitramino-1,2,4-triazole, and 5-nitraminotetrazole; and azines such as melamine.

The gas generants further contain a metallic oxidizer selected from alkali metal and alkaline earth metal nitrates and perchlorates. One of ordinary skill will readily appreciate that other oxidizers such as metallic oxides, nitrites, chlorates, peroxides, and hydroxides may also be used. The metallic oxidizer is present at about 0.1–25%, and more preferably 0.8–15%, by weight of the gas generating composition.

The gas generants yet further contain an inert component such as an inert mineral selected from the group containing silicates, silicon, diatomaceous earth, and oxides such as silica, alumina, and titania. The silicates include but are not limited to silicates having layered structures such as talc and the aluminum silicates of clay and mica; aluminosilicates; borosilicates; and, other silicates such as sodium silicate and potassium silicate. The inert component is present at about 0.1–8%, and more preferably at about 0.1–3%, by weight of the gas generating composition.

DETAILED DESCRIPTION OF THE PREFERRED EMBODIMENTS

In accordance with the present invention, the preferred high nitrogen nonazides employed as primary fuels in gas generant compositions include, in particular, ammonium, amine, amino, and amide nonmetal salts of tetrazole and triazole selected from the group including monoguanidinium salt of 5,5'-Bi-1H-tetrazole (BHT.1GAD), diguanidinium salt of 5,5'-Bi-1H-tetrazole (BHT.2GAD), monoaminoguanidinium salt of 5,5'-Bi-1H-tetrazole (BHT.1AGAD), diaminoguanidinium salt of 5,5'-Bi-1H-tetrazole (BHT.2AGAD), monohydrazinium salt of 5,5'-Bi-1H-tetrazole (BHT.1HH), dihydrazinium salt of 5,5'-Bi-1H-tetrazole (BHT.2HH), monoammonium salt of 5,5'-Bi-1H-tetrazole (BHT.1$NH_3$), diammonium salt of 5,5'-Bi-1H-tetrazole (BHT.2$NH_3$), mono-3-amino-1,2,4-triazolium salt of 5,5'-Bi-1H-tetrazole (BHT.1ATAZ), di-3-amino-1,2,4-triazolium salt of 5,5'-Bi-1H-tetrazole (BHT.2ATAZ), diguanidinium salt of 5,5'-Azobis-1H-tetrazole (ABHT.2GAD), and monoammonium salt of 5-Nitramino-1H-tetrazole (NAT-1$NH_3$). The primary fuel generally comprises about 13 to 38%, and more preferably about 23 to 28%, by weight of the gas generating composition.

Formula I

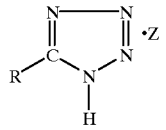

Formula II

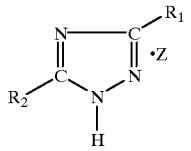

A generic nonmetal salt of tetrazole as shown in Formula I includes a cationic component, Z, and an anionic component comprising a tetrazole ring and an R group substituted on the 5-position of the tetrazole ring. A generic nonmetal salt of triazole as shown in Formula II includes a cationic component, Z, and an anionic component comprising a triazole ring and two R groups substituted on the 3- and 5-positions of the triazole ring, wherein $R_1$ may or may not be structurally synonymous with $R_2$. An R component is selected from a group including hydrogen or any nitrogen-containing compound such as an amino, nitro, nitramino, or a tetrazolyl or triazolyl group from Formula I or II, respectively, substituted directly or via amine, diazo, or triazo groups. The compound Z forms a cation by displacing a hydrogen atom at the 1-position of either formula, and is selected from an amine group including ammonia, hydrazine; guanidine compounds such as guanidine, aminoguanidine, diaminoguanidine, triaminoguanidine, and nitroguanidine; amides including dicyandiamide, urea, carbohydrazide, oxamide, oxamic hydrazide, Bi-(carbonamide)amine, azodicarbonamide, and hydrazodicarbonamide; and substituted azoles including 3-amino-1,2,4-triazole, 3-amino-5-nitro-1,2,4-triazole, 5-aminotetrazole, 3-nitramino-1,2,4-triazole, and 5-nitraminotetrazole; and azines such as melamine.

The foregoing nonmetal salts of tetrazole or triazole are dry-mixed with phase stabilized ammonium nitrate (PSAN). PSAN is generally employed in a concentration of about 46 to 87%, and more preferably 56 to 77%, by weight of the total gas generant composition. The ammonium nitrate is stabilized by potassium nitrate, as described in Example 16, and as taught in co-owned U.S. Pat. No. 5,531,941, entitled, "Process For Preparing Azide-Free Gas Generant Composition", and granted on Jul. 2, 1996, incorporated herein by reference. The PSAN comprises 85–90% AN and 10–15% KN and is formed by any suitable means such as co-crystallization of AN and KN, so that the solid-solid phase changes occurring in pure ammonium nitrate (AN) between −40° C. and 107° C. are prevented. Although KN is preferably used to stabilize pure AN, one skilled in the art will readily appreciate that other stabilizing agents may be used in conjunction with AN.

The gas generants further contain a metallic oxidizer selected from alkali metal and alkaline earth metal nitrates and perchlorates. One of ordinary skill will readily appreciate that other oxidizers such as metallic oxides, nitrites, chlorates, peroxides, and hydroxides may also be used. The metallic oxidizer is present at about 0.1–25%, and more preferably 0.8–15%, by weight of the gas generating composition.

The gas generants yet further contain an inert component selected from the group containing silicates, silicon, diatomaceous earth, and oxides such as silica, alumina, and titania. The silicates include but are not limited to silicates having layered structures such as talc and the aluminum silicates of clay and mica; aluminosilicate; borosilicates; and other silicates such as sodium silicate and potassium silicate. The inert component is present at about 0.1–8%, and more preferably at about 0.1–3%, by weight of the gas generating composition.

A preferred embodiment contains 56–77% of PSAN, 23–28% of diammonium salt of 5,5'-Bi-1H-tetrazole (BHT.2NH3), 0.8–15% of strontium nitrate, and 0.1–3% of clay.

The combination of the metallic oxidizer and the inert component results in the formation of a mineral containing the metal from the metallic oxidizer. For example, the combination of clay, which is primarily aluminum silicate ($Al_2Si_4O_{10}$) and quartz ($SiO_2$) with strontium nitrate ($Sr(NO_3)_2$) results in a combustion product consisting primarily of strontium silicates ($SrSiO_4$ and $Sr_3SiO_5$). It is believed that this process aids in sustaining the gas generant combustion at all pressures and thus prevents inflator "no-fires".

Burn rates of gas generants containing a nonmetal salt as defined above, PSAN, an alkaline earth metal oxidizer, and an inert component are low (around 0.30 ips at 1000 psi), lower than the industry standard of 0.40 ips at 1000 psi. Thus, these compositions quite unexpectedly ignite and sustain combustion much more readily than other gas generants having burn rates below 0.40 ips at 1000 psi, and in some cases, perform better than gas generants having burn rates greater than 0.40 ips.

Optional ignition aids, used in conjunction with the present invention, are selected from nonazide fuels including triazoles, triazolone, aminotetrazoles, tetrazoles, or bitetrazoles, or others as described in U.S. Pat. No. 5,139,588 to Poole, the teachings of which are herein incorporated by reference. Conventional ignition aids such as $BKNO_3$ are no longer required because a gas generant containing a tetrazole or triazole based fuel, phase stabilized ammonium nitrate, a metallic oxidizer, and an inert component exhibits improved ignitability of the propellant and also provides a sustained burn rate with repeatable combustible performance.

The manner and order in which the components of the gas generating composition of the present invention are combined and compounded is not critical so long as a uniform mixture is obtained and the compounding is carried out under conditions which do not cause decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction.

The present invention is illustrated by the following examples, wherein the components are quantified in weight percent of the total composition unless otherwise stated. Values for examples 1–3 and 16–20 were obtained experimentally. Examples 18–20 provide equivalent chemical percentages as found in Examples 1–3 and are included for comparative purposes and to elaborate on the laboratory findings. Values for examples '4–15 are obtained based on the indicated compositions. The primary gaseous products are $N_2$, $H_2O$, and $CO_2$, and, the elements which form solids are generally present in their most common oxidation state. The oxygen balance is the weight percent of $O_2$ in the composition which is needed or liberated to form the stoichiometrically balanced products. Therefore, a negative oxygen balance represents an oxygen deficient composition whereas a positive oxygen balance represents an oxygen rich composition.

When formulating a composition, the ratio of PSAN to fuel is adjusted such that the oxygen balance is between −4.0% and +1.0% $O_2$ by weight of composition as described above. More preferably, the ratio of PSAN to fuel is adjusted such that the composition oxygen balance is between −2.0% and 0.0% $O_2$ by weight of composition. It can be appreciated that the relative amount of PSAN and fuel will depend both on the additive used to form PSAN as well as the nature of the selected fuel.

In Tables 1 and 2 below, PSAN is phase-stabilized with 15% KN of the total oxidizer component in all cases except those marked by an asterisk. In that case, PSAN is phase-stabilized with 10% KN of the total oxidizer component.

In accordance with the present invention, these formulations will be both thermally and volumetrically stable over a temperature range of −40° C. to 110° C.; produce large volumes of non-toxic gases; produce minimal solid particulates; ignite readily and burn in a repeatable manner; contain no toxic, sensitive, or explosive starting materials; and, be non-toxic, insensitive, and non-explosive in final form.

TABLE 1

| EX | Composition by Weight Percent | Moles of Gas/ 100 g of Generant | Grams of Solids/ 100 g of Generant | Oxygen Balance by Weight Percent | Burn Rate at 1000 psi (in/sec) |
|---|---|---|---|---|---|
| 1 | 76.43% PSAN 23.57% BHT.2$NH_3$ | 4.00 | 5.34 | 0.0% | 0.48 |
| 2 | 75.40% PSAN 24.60% BHT.2$NH_3$ | 4.00 | 5.27 | −1.0% | 0.47 |
| 3 | 72.32% PSAN 27.68% BHT.2$NH_3$ | 4.00 | 5.05 | −4.0% | 0.54 |

TABLE 2

| EX | Composition in Weight Percent | Mol Gas/ 100 g of Generant | Grams of Solids/ 100 g of Generant | Oxygen Balance in Weight Percent |
|---|---|---|---|---|
| 4 | 73.06% PSAN* 26.94% BHT.2$NH_3$ | 4.10 | 3.40 | −4.0% |
| 5 | 76.17% PSAN* 23.83% BHT.2$NH_3$ | 4.10 | 3.55 | −1.0% |
| 6 | 78.25% PSAN* 21.75% BHT.2$NH_3$ | 4.10 | 3.65 | +1.0% |
| 7 | 73.08% PSAN 26.92% BHT.1GAD | 3.95 | 5.11 | −4.0% |
| 8 | 76.08% PSAN 23.92% BHT.1GAD | 3.95 | 5.32 | −1.0% |
| 9 | 78.08% PSAN 21.92% BHT.1GAD | 3.95 | 5.46 | +1.0% |
| 10 | 73.53% PSAN 26.47% ABHT.2GAD | 3.95 | 5.14 | −4.0% |
| 11 | 76.48% PSAN 23.52% ABHT.2GAD | 3.95 | 5.34 | −1.0% |
| 12 | 78.45% PSAN 21.55% ABHT.2GAD | 3.95 | 5.48 | +1.0% |
| 13 | 46.27% PSAN 53.73% NAT.1$NH_3$ | 3.94 | 3.23 | −4.0% |
| 14 | 52.26% PSAN 47.74% NAT.1$NH_3$ | 3.94 | 3.65 | −1.0% |
| 15 | 56.25% PSAN 43.75% NAT.1$NH_3$ | 3.95 | 3.93 | +1.0% |

EXAMPLE 16—Illustrative

Phase-stabilized ammonium nitrate (PSAN) consisting of 85 wt % ammonium nitrate (AN) and 15 wt % potassium nitrate (KN) was prepared as follows. 2125 g of dried AN and 375 g of dried KN were added to a heated jacket double planetary mixer. Distilled water was added while mixing until all of the AN and KN had dissolved and the solution temperature was 66–70° C. Mixing was continued at atmospheric pressure until a dry, white powder formed. The product was PSAN. The PSAN was removed from the mixer, spread into a thin layer, and dried at 80° C. to remove any residual moisture.

EXAMPLE 17—Illustrative

The PSAN prepared in example 16 was tested as compared to pure AN to determine if undesirable phase changes normally occurring in pure AN had been eliminated. Both were tested in a DSC from 0° C. to 200° C. Pure AN showed endotherms at about 57° C. and about 133° C., corresponding to solid-solid phase changes as well as a melting point endotherm at about 170° C. PSAN showed an endotherm at about 118° C. corresponding to a solid-solid phase transition and an endotherm at about 160° C. corresponding to the melting of PSAN.

Pure AN and the PSAN prepared in example 16 were compacted into 12 mm diameter by 12 mm thick slugs and measured for volume expansion by dilatdmetry over the temperature range −40° C. to 140° C. When heating from −40° C. to 140° C. the pure AN experienced a volume contraction beginning at about −34° C., a volume expansion beginning at about 44° C., and a volume contraction beginning at about 90° C. and a volume expansion beginning at about 130° C. The PSAN did not experience any volume change when heated from −40° C. to 107° C. It did experience a volume expansion beginning at about 118° C.

Pure AN and the PSAN prepared in example 16 were compacted into 32 mm diameter by 10 mm thick slugs, placed in a moisture-sealed bag with desiccant, and temperature cycled between −40° C. and 107° C. 1 cycle consisted of holding the sample at 107° C. for 1 hour, transitioning from 107° C. to −40° C. at a constant rate in about 2 hours, holding at −40° C. for 1 hour, and transitioning from −40° C. to 107° C. at a constant rate in about 1 hour. After 62 complete cycles, the samples were removed and observed. The pure AN slug had essentially crumbled to powder while the PSAN slug remained completely intact with no cracking or imperfections.

The above example demonstrates that the addition of KN up to and including 15 wt % of the co-precipitated mixtures of AN and KN effectively removes the solid-solid phase transitions present in AN over the automotive application range of −40° C. to 107° C.

EXAMPLE 18

A mixture of PSAN and BHT.2$NH_3$ was prepared having the following composition in percent by weight: 76.43% PSAN and 23.57% BHT.2$NH_3$. The weighed and dried components were blended and ground to a fine powder by tumbling with ceramic cylinders in a ball mill jar. The powder was separated from the grinding cylinders and granulated to improve the flow characteristics of the material. The granules were compression molded into pellets on a high speed rotary press. Pellets formed by this method were of exceptional quality and strength.

The burn rate of the composition was 0.48 inches per second at 1000 psi. The burn rate was determined by measuring the time required to burn a cylindrical pellet of known length at a constant pressure. The pellets were compression molded in a ½" diameter die under a 10 ton load, and then coated on the sides with an epoxy/titanium dioxide inhibitor which prevented burning along the sides.

The pellets formed on the rotary press were loaded into a gas generator assembly and found to ignite readily and inflate an airbag satisfactorily, with minimal solids, airborne particulates, and toxic gases produced. Approximately 95% by weight of the gas generant was converted to gas. The ignition aid used contained no booster such as $BKNO_3$, but only high gas yield nonazide pellets such as those described in U.S. Pat. No. 5,139,588.

As tested with a standard Bureau of Mines Impact Apparatus, the impact sensitivity of this mixture was greater than 300 kp•cm. As tested according to U.S. D.O.T. procedures pellets of diameter 0.184" and thickness of 0.080" did not deflagrate or detonate when initiated with a No. 8 blasting cap.

EXAMPLE 19

A mixture of PSAN and BHT.2$NH_3$ was prepared having the following composition in percent by weight: 75.40% PSAN and 24.60% BHT.2$NH_3$. The composition was prepared as in Example 18, and again formed pellets of exceptional quality and strength. The burn rate of the composition was 0.47 inches per second at 1000 psi.

The pellets formed on the rotary press were loaded into a gas generator assembly. The pellets were found to ignite readily and inflate an airbag satisfactorily, with minimal solids, airborne particulates, and toxic gases produced. Approximately 95% by weight of the gas generant was converted to gas.

As tested with a standard Bureau of Mines Impact Apparatus, the impact sensitivity of this mixture was greater than 300 kp•cm. As tested according to U.S. Department of Transportation procedures, pellets of diameter 0.250" and thickness of 0.125" did not deflagrate or detonate when initiated with a No. 8 blasting cap.

EXAMPLE 20

A mixture of PSAN and BHT.2$NH_3$ was prepared having the following composition in percent by weight: 72.32% PSAN and 27.68% BHT.2$NH_3$. The composition was prepared as in example 18, except that the weight ratio of grinding media to powder was tripled. The burn rate of this composition was found to be 0.54 inches per second at 1000 psi. As tested with a standard Bureau of Mines Impact Apparatus, the impact sensitivity of this mixture was greater than 300 kp•cm. This example demonstrates that the burn rate of the compositions of the present invention can be increased with more aggressive grinding. As tested according to U.S.D.O.T. regulations, pellets having a diameter of 0.184" and thickness of 0.090" did not deflagrate or detonate when initiated with a No. 8 blasting cap.

In accordance with the present invention, the ammonium nitrate-based propellants are phase stabilized, sustain combustion at pressures above ambient, and provide abundant nontoxic gases while minimizing particulate formation. Because the nonmetal salts of tetrazole and triazole, in combination with PSAN, are easily ignitable, conventional ignition aids such as $BKNO_3$ are not required to initiate combustion.

Furthermore, due to reduced sensitivity and in accordance with U.S.D.O.T. regulations, the compositions readily pass the cap test at propellant tablet sizes optimally designed for use within the air bag inflator. As such, a significant advantage of the present invention is that it contains nonhazardous and nonexplosive starting materials, all of which can be shipped with minimal restrictions.

Comparative data of the prior art and that of the present invention are shown in Table 3 to illustrate the gas generating benefit of utilizing the tetrazole and triazole amine salts in conjunction with PSAN.

TABLE 3

| | Comparative Gas Production | | | |
|---|---|---|---|---|
| U.S. Pat. No. | mol gas/ 100 g prop. | mol gas/ 100 $cm^3$ gas generant | $cm^3$ gas generant/ mol gas | Comparative Propellant Volume For Equal Amount of Gas Output |
| 4,931,111 Azide | 1.46 | 3.43 | 29.17 | 193% |
| 5,139,588 Nonazide | 2.18 | 4.96 | 20.16 | 133% |
| 5,431,103 Nonazide | 1.58 | 5.26 | 19.03 | 126% |
| Present Invention | 4.00 | 6.60 | 15.15 | 100% |

As shown in Table 3, and in accordance with the present invention, PSAN and amine salts of tetrazole or triazole produce a significantly greater amount of gas per cubic centimeter of gas generant volume as compared to prior art compositions. This enables the use of a smaller inflator due to a smaller volume of gas generant required. Due to greater gas production, formation of solids are minimized thereby allowing for smaller and simpler filtration means which also contributes to the use of a smaller inflator.

In yet another aspect of the invention, it has also been discovered that certain gas generating compositions containing PSAN and a nonmetal salt of tetrazole or a nonmetal salt of triazole may exhibit poor ignitability and incomplete combustion thereby resulting in an inadequate rate of gas production and/or in "no-fires". As shown in Examples 21–27 in Table 4, by adding a metallic oxidizer and an inert component in the percentages given above, silicates are formed thereby improving ignitability and sustaining combustion at all pressures.

TABLE 4

| | Example | | | | | | |
|---|---|---|---|---|---|---|---|
| | 21 | 22 | 23 | 24 | 25 | 26 | 27 |
| Components | | | | | | | |
| PSAN (10 wt % KN) | 75.1 | 67.2 | 66.4 | 73.1 | 56.3 | 65.4 | 74.0 |
| BHT-2NH3 | 24.9 | 19.8 | 26.1 | 24.3 | 26.6 | 25.8 | 25.0 |
| Sr(NO3)2 | | | 7.5 | | 14.5 | 7.5 | 0.8 |
| Clay | | | | 2.6 | 2.6 | 1.3 | 0.2 |
| Nitroguanidine | | 13.0 | | | | | |
| Gas and Solids | | | | | | | |
| Gas Conversion (wt. %) | 97 | 97 | 94 | 94 | 88 | 92 | 96 |
| 60L Tank Solids (g) | nd | 0.32 | 0.32 | 0.24 | 0.26 | 0.36 | 0.35 |
| 100 $ft^3$ Particulates ($mg/m^3$) | nd | 130 | 123 | 110 | 140 | 120 | 174 |
| Combustion | | | | | | | |
| Solid Residue | nd | nd | $SrCO_3$ | $K_2CO_3$ | $Sr_2SiO_4$ | $Sr_2SiO_4$ | nd |
| Inflator No-Fires? | yes | yes | yes | no | no | no | no |
| Burn at Atmospheric P? | no | no | no | yes | yes | yes | sometimes |
| Burn at 100 psi? | no | no | sometimes | yes | yes | yes | sometimes |
| Burn Rates | | | | | | | |
| 1K psi (in/sec) | 0.49 | 0.44 | 0.47 | 0.25 | 0.28 | 0.28 | 0.45 |
| 3K psi (in/sec) | 1.19 | 0.97 | 0.84 | 0.57 | 0.58 | 0.66 | 1.06 |
| 5K psi (in/sec) | 1.37 | 0.97 | 1.05 | 0.80 | 0.78 | 0.90 | 1.27 |
| Low P n (<2.5K) | 0.89 | 0.93 | 1.04 | 0.75 | 0.68 | 0.82 | 1.00 |
| Exponent Break (psi) | 2500 | 2000 | 1000,3000 | none | none | none | 2000 |
| High P n (>2.5K | 0.41 | 0.16 | 0.24 | 0.75 | 0.68 | 0.82 | 0.47 |
| Effluents* | | | | | | | |
| CO % | nd | 160 | 107 | 98 | 105 | 100 | 92 |
| $NH_3$ % | nd | 141 | 81 | 276 | 117 | 100 | 125 |
| NO % | nd | 58 | 83 | 265 | 83 | 100 | 119 |
| $NO_2$ % | nd | 25 | 50 | 1075 | 30 | 100 | 80 |

nd—indicates that no data is available

*The effluents are written as a percentage of values of Example 26.

EXAMPLES 21–27

In Examples 21–27, the phase stabilized ammonium nitrate (PSAN) contained 10% KN by weight and was prepared by cocrystallization from a saturated water solution at about 80° C. The diammonium salt of 5,5'-Bi-1H-tetrazole (BHT.2$NH_3$), strontium nitrate, clay, and nitroguanidine (NQ) were purchased from an outside supplier.

Each material was dried separately at 105° C. The dried materials were then mixed together and tumbled with alumina cylinders in a large ball mill jar. After separating the alumina cylinders, the final product was collected: 1500 g of homogeneous, pulverized powder. The powder was formed into granules to improve the flow properties, and then compression molded into pellets (0.184" diameter, 0.090" thick) on a high speed tablet press. The tablets were loaded into inflators and fired inside a 60 L tank and a 100 $ft^3$ tank. The 60 L tank was used to determine the pressure over time and to measure the amount of solids that were expelled from the inflator during deployment. The 100 $ft^3$ tank was used to determine the levels of certain gases as well as the amount of airborne particulates produced by the inflator. Table 1 summarizes the results for each of the compositions.

Examples 21–24 are shown for comparative purposes. Example 21 contains PSAN and BHT-2NH3. Example 22 contains PSAN, BHT-2NH3, and NQ. Example 23 contains PSAN, BHT-2NH3, and strontium nitrate (a metallic oxidizer). Example 24 contains PSAN, BHT-2NH3, and clay (an inert component). In accordance with the present invention, Examples 25 and 26 contain PSAN, BHT-2NH3, strontium nitrate as a metallic oxidizer, and clay as an inert component. Finally, Example 27 contains PSAN, BHT-2NH3, strontium nitrate as a metallic oxidizer, and clay as an inert component, but in amounts other than as described above. Applicants have discovered that adding the metallic oxidizer and an inert component to the compositions of Examples 21 and 22 (and similar compositions as taught hereinabove), results in sustained combustion and optimum ignitability. Nevertheless, one of ordinary skill in the art will readily appreciate that redesigning the inflator to operate at a higher combustion pressure, for example, would still make the compositions of Examples 21 and 22 useful in an automotive airbag application.

As shown in Table 4, Examples 21–27 are typical high yield gas generants that produce large volumes of gases with minimal solid particulates. The gas conversion is the percent by weight of solid gas generant that is converted to gas after combustion. Although the gas conversion of Examples 25 and 26 is slightly lower than in Examples 21–24 and 27, there are no significant differences in the amount of solids produced by an inflator in a 60 L tank. This demonstrates that the compositions of Examples 25 and 26 are essentially high yield gas generants despite a slight decrease in the gas conversion as compared to Examples 21–24 and 27. All of the Examples presented in Table 4 are thermally and volumetrically stable from −40° C. to 110° C., and contain no explosive components.

It has been discovered that in certain inflator designs, the compositions of Examples 21–23 (and similar compositions as described above) can sometimes experience a "no-fire" situation whereby only a portion of the gas generant is combusted. This is unacceptable for airbag operations demanding a specific rate of gas production, and therefore requires more complicated inf lators operable at higher pressures. On the other hand, the compositions of Examples 25–27 when fired consistently result in complete combustion without delay.

Burn rate data is presented to further describe the advantages of combining PSAN, a nonmetal salt of tetrazole or a nonmetal salt of triazole, a metallic oxidizer, and an inert component. The burn rate model $R_b=aP^n$ was assumed to apply, where $R_b$=burn rate, a=a constant, P=pressure, and n=the pressure exponent. Note that the relationship between the burn rate and pressure, and hence a and n, can change as a function of pressure. When this occurs, there is a "break" in the burn rate vs. pressure curve, indicating a transition to a different combustion mechanism. Ideally, a gas generant composition should have a single burning mechanism over the entire inflator operating pressure. In addition, the gas generant should ignite easily and sustain combustion over these pressures. FIG. 1 illustrates the "break" in the pressure exponent of a gas generant. In FIG. 1, the burn rate vs. pressure curves for Examples 21–23 and 26 are presented. Note that the composition of Example 26 when combusted shows no "breaks" thereby indicating a single mechanism of combustion, maintained and occurring in all of the inflator operating pressures.

At pressures above about 3000 psi, all of the compositions ignite easily and sustain combustion. As the pressure decreases below 2000–3000 psi, Examples 21–23 experience a significant increase in the pressure exponent. This indicates a transition to a combustion mechanism that is much more dependent on pressure. At this point, a small decrease in pressure can dramatically reduce the burning rate of the gas generant and eventually cause it to extinguish. In fact, it has been found that certain inflators containing compositions 21–23 sometimes do not function properly because only a small portion of the gas generant has been consumed. This phenomena was also observed at very low pressures. When ignited at atmospheric with a propane torch, compositions 21–23 began to burn, but always extinguished. Furthermore, these compositions did not ignite and burn to completion at 100 psi when tested in a burn rate apparatus.

In contrast, as shown in FIG. 1 (note the absence of a "break" in the curve of composition 26), composition 26 ignites and burns easily and has the same pressure exponent from 0–4500 psi. When ignited with a propane torch at atmospheric pressure, composition 26 ignited easily and burned slowly to completion. At 100 psi in a burn rate apparatus, composition 26 ignited and burned completely. Inflators containing composition 26 functioned properly on all occasions with easy ignitability, and complete and steady consumption of the gas generant. Inflator operating characteristics were relatively equivalent when composition 25 was used. Note that despite low levels of a metallic oxidizer and an inert component, and burn rate properties similar to compositions 21–23, composition 27 functions at the inflator level with complete consumption of the gas generant.

Composition 24 contains PSAN, the primary fuel (BHT-2NH3), and an inert component. "No-fires" or combustion delays were not a problem at the inflator level. However, this formulation produces high levels of undesirable gases. Compared to Examples 21–23, and 25–27, composition 24 has a similar CO level, but much higher levels of ammonia, NO, and $NO_2$, making the composition unsuitable for automotive applications. This indicates the importance of the metallic oxidizer in preventing the production of toxic gases.

X-ray diffraction (XRD) was completed on the solid residue from compositions 23–26. The major phases are presented in Table 4. The use of $Sr(NO_3)_2$ alone in composition 23 results in the formation of mainly $SrCO_3$ with problems of inflator "no-fires". The use of clay alone in composition 24 results in the formation of mainly $K_2CO_3$ with problems of high levels of toxic effluents at the inflator level. The use of both $Sr(NO_3)_2$ and clay in compositions 25 and 26 results in the formation of mainly strontium silicate, $Sr_2SiO_4$, without occurrence of "no-fires" or highly toxic effluent levels.

In sum, Examples 21–27 demonstrate that the addition of both the metallic oxidizer and inert component to PSAN and the primary fuel is necessary to form a metallic silicate product during the combustion process. The result is a high-gas yield generant that is readily ignitable and burns to completion at all operating pressures, and yet produces minimal solid particulates and minimal toxic gases.

While the foregoing examples illustrate the use of preferred fuels and oxidizers it is to be understood that the practice of the present invention is not limited to the particular fuels and oxidizers illustrated and similarly does not exclude the inclusion of other additives as described above and as defined by the following claims.

We claim:

1. A gas generant composition useful for inflating an automotive air bag passive restraint system comprising a mixture of:

a high-nitrogen fuel selected from the class consisting of 1-, 3-, and 5-substituted nonmetal salts of triazoles, and, 1- and 5-substituted nonmetal salts of tetrazoles;

a first oxidizer selected from the group consisting of phase stabilized ammonium nitrate;

a metallic second oxidizer; and an inert component.

2. A gas generant composition as claimed in claim 1 wherein said fuel is employed in a concentration of 13 to 38% by weight of the gas generant composition, said first oxidizer is employed in a concentration of 46 to 87% by weight of the gas generant composition, said metallic second oxidizer is employed in a concentration of 0.1 to 25% by weight of the gas generant composition, and said inert component is employed in a concentration of 0.1 to 8% by weight of the gas generant composition.

3. A gas generant composition of claim 1 wherein said inert component is selected from the group consisting of silicates, aluminosilicates, aluminum silicates, oxides, borosilicates, diatomaceous earth, silicon, or mixtures thereof.

4. A gas generant composition of claim 3 wherein said silicates are selected from the group consisting of sodium silicate, talc, and potassium silicate.

5. A gas generant composition of claim 3 wherein said aluminum silicates are selected from the group consisting of clay and mica.

6. A gas generant composition of claim 3 wherein said oxides are selected from the group consisting of iron oxide, alumina, silica, and titania.

7. A gas generant composition of claim 1 wherein said metallic oxidizer is selected from the group consisting of alkali and alkaline earth metal nitrates and perchlorates.

8. A gas generant composition of claim 7 wherein said alkaline earth metal nitrates are selected from the group consisting of strontium nitrate, calcium nitrate, and magnesium nitrate.

9. A gas generant composition useful for inflating an automotive air bag passive restraint system comprising a mixture of:

a high-nitrogen fuel selected from the class consisting of 1-, 3-, 5-substituted amine salts of triazoles and 1- and 5-substituted amine salts of tetrazoles, said fuel employed in a concentration of 13 to 38% by weight of the gas generant composition;

a first oxidizer consisting of phase stabilized ammonium nitrate, said first oxidizer employed in a concentration of 46 to 87% by weight of the gas generant composition;

a metallic second oxidizer employed in a concentration of 0.1 to 25% by weight of the gas generant composition; and an inert component employed in a concentration of 0.1 to 8% by weight of the gas generant composition, wherein said fuel is selected from the group consisting of monoguanidinium salt of 5,5'-Bi-1H-tetrazole, diguanidinium salt of 5,5'-Bi-1H-tetrazole, monoaminoguanidinium salt of 5,5'-Bi-1H-tetrazole, diaminoguanidinium salt of 5,5'-Bi-1H-tetrazole monohydrazinium salt of 5,5'-Bi-1H-tetrazole, dihydrazinium salt of 5,5'-Bi-1H-tetrazole, monoammonium salt of 5,5'-Bi-1H-tetrazole, diammonium salt of 5,5'-Bi-1H-tetrazole, mono-3-amino-1,2,4-triazolium salt of 5,5'-Bi-1H-tetrazole, di-3-amino-1,2,4-triazolium salt of 5,5'-Bi-1H-tetrazole, diguanidinium salt of 5,5'-Azobis-1H-tetrazole, and monoammonium salt of 5-Nitramino-1H-tetrazole.

10. A gas generant composition of claim 9 wherein said inert component is selected from the group consisting of silicates, aluminosilicates, oxides, borosilicates, diatomaceous earth, silicon, or mixtures thereof.

11. A gas generant composition of claim 10 wherein said silicates are selected from the group consisting of sodium silicate, talc, and potassium silicate.

12. A gas generant composition of claim 10 wherein said aluminum silicates are selected from the group consisting of clay and mica.

13. A gas generant composition of claim 10 wherein said oxides are selected from the group consisting of iron oxide, alumina, silica, and titania.

14. A gas generant composition of claim 9 wherein said metallic oxidizer is selected from the group consisting of alkali and alkaline earth metal nitrates and perchlorates.

15. A gas generant composition of claim 14 wherein said alkaline earth metal nitrates are selected from the group consisting of strontium nitrate, calcium nitrate, and magnesium nitrate.

16. A gas generant composition of claim 9 comprising 56–77% of PSAN, 23–28% of diammonium salt of 5,5'-Bi-1H-tetrazole (BHT-2NH3), 0.8–15% of strontium nitrate, and 0.1–3% of clay, said percentages taken by weight of the gas generant composition.

* * * * *

UNITED STATES PATENT AND TRADEMARK OFFICE

CERTIFICATE OF CORRECTION

PATENT NO. : 6,210,505 B1
DATED : April 3, 2001
INVENTOR(S) : Khandhadia et al.

It is certified that error appears in the above-identified patent and that said Letters Patent is hereby corrected as shown below:

Title page,
Item [73], insert Assignee, should read:
-- Automotive Systems Laboratory, Inc.
27200 Haggerty Road
Suite B-12
Farmington Hills, Michigan 48331 --

Signed and Sealed this

Seventh Day of May, 2002

*Attest:*

*Attesting Officer*

JAMES E. ROGAN
*Director of the United States Patent and Trademark Office*